United States Patent [19]

Zimmermann

[11] Patent Number: 4,619,757

[45] Date of Patent: Oct. 28, 1986

[54] TWO STAGE HYDROTREATING PRETREATMENT IN PRODUCTION OF OLEFINS FROM HEAVY HYDROCARBONS

[75] Inventor: Heinz Zimmermann, Munich, Fed. Rep. of Germany

[73] Assignee: Linde Aktiengesellschaft, Wiesbaden, Fed. Rep. of Germany

[21] Appl. No.: 683,764

[22] Filed: Dec. 19, 1984

Related U.S. Application Data

[63] Continuation-in-part of Ser. No. 546,354, Oct. 28, 1983, abandoned, which is a continuation-in-part of Ser. No. 527,952, Aug. 31, 1983, abandoned.

[30] Foreign Application Priority Data

Aug. 31, 1982 [DE] Fed. Rep. of Germany ..... 3232395

[51] Int. Cl.[4] ..... C10G 65/08; C10G 69/06

[52] U.S. Cl. ..... 208/57; 208/61; 208/143; 208/97

[58] Field of Search ..... 208/57, 142, 143, 61, 208/97

[56] References Cited

U.S. PATENT DOCUMENTS

| | | | |
|---|---|---|---|
| 3,161,586 | 12/1964 | Watkins | 208/264 |
| 3,898,299 | 8/1975 | Jones | 208/61 |
| 3,944,481 | 3/1976 | Wing et al. | 208/58 |
| 4,019,976 | 4/1977 | Cosyns et al. | 208/57 |
| 4,145,276 | 3/1979 | Cosyns et al. | 208/143 |
| 4,188,281 | 2/1980 | Wernicke et al. | 208/89 |
| 4,324,935 | 4/1982 | Wernicke et al. | 208/108 |

FOREIGN PATENT DOCUMENTS

| | | | |
|---|---|---|---|
| 2364879 | 5/1978 | France | 208/61 |

*Primary Examiner*—Brian E. Hearn
*Assistant Examiner*—O. Chaudhuri
*Attorney, Agent, or Firm*—Millen & White

[57] ABSTRACT

Low-molecular weight olefins from heavy hydrocarbons are obtained with a hydrogenating pretreatment and a subsequent thermal cracking of at least a portion of the hydrogenated product. In the first stage, the polyaromatic content of a first hydrocarbon fraction high in polyaromatic compounds, e.g., a vacuum gas oil, is selectively degraded with a zeolitic hydrotreating catalyst, and in a second stage the resultant hydrocarbons are refined with a non-zeolitic hydrotreating catalyst in admixture with a second heavy hydrocarbon fraction low in polyaromatic compounds, e.g., and atmospheric gas oil. This two-stage process permits the utilization of lower operating pressures as compared to the separate treatment of the heavy hydrocarbon fractions.

28 Claims, No Drawings

TWO STAGE HYDROTREATING PRETREATMENT IN PRODUCTION OF OLEFINS FROM HEAVY HYDROCARBONS

CROSS REFERENCE TO RELATED APPLICATIONS

This application is a continuation-in-part of application Ser. No. 546,354 filed Oct. 28, 1983 which was a continuation-in-part of application Ser. No. 527,952 filed Aug. 31, 1983, said application being incorporated by reference herein, both abandoned.

BACKGROUND OF THE INVENTION

This invention relates to a process for producing low-molecular weight olefins, e.g., ethylene from heavy hydrocarbons, comprising a hydrogenating pretreatment and a subsequent thermal cracking of at least part of the hydrogenation product.

Light starting materials, that is, hydrocarbons with a boiling point below 200° C., such as naphtha, are particularly well suited for cracking hydrocarbons in order to produce olefins. They result in high cracking yields and produce few undesirable byproducts.

The great demand for such suitable starting materials for cracking will probably cause a scarcity and price increases for these substances. For some time, therefore, an attempt has been made to develop methods which permit the favorable utilization of a starting materials having higher boiling points.

In principle, the utilization of starting materials with higher boiling points results in lower yields of valuable cracking products; moreover, hydrocarbon fractions having boiling points over 200° C., and which can be utilized only with difficulty are being produced in increasing amounts. Still further difficulties arise because starting materials with higher boiling points result in increased coke and tar formation in the cracking plant. These products, which are deposited on the walls of the various conduit elements, such as pipelines and heat exchangers, necessarily impair heat transfer and can also cause flow constrictions. When such materials are used, it is therefore necessary to remove such deposits more frequently than when light hydrocarbons are used.

A method intended to solve this problem is known from U.S. Pat. No. 3,781,195 (DE-OS No. 21 64 951), in which heavy hydrocarbons are catalytically hydrogenated prior to the thermal cracking. As a result, the proportion of aromatic, and especially polycyclic aromatic, compounds in the starting material, which are the primary cause of the undesirable products of cracking, is reduced. A desulfuration of the starting material takes place as well. Other prior art includes modifications of hydrotreating pretreatment process, for example, assignee's U.S. Pat. Nos. 4,297,204, 4,256,871, 4,260,474, 4,324,935 and 4,310,409. (The terms "hydrogenation" and "hydrotreating" are used interchangeably.)

SUMMARY

An object of the present invention is to provide an improved method of the general type discussed above.

Upon further study of the specification and appended claims, further objects and advantages of this invention will become apparent to those skilled in the art.

These objects are attained in accordance with the invention by conducting the hydrogenation in two stages. In the first stage, the content of polyaromatic substances in a first hydrocarbon fraction which is high in polyaromatic compounds is selectively degraded, and in the second stage, a refining of the hydrocarbons is effected; furthermore, in the second stage, a second heavy hydrocarbon fraction low in the polyaromatic compounds is added. Additionally, there are employed different catalysts in the two stages—a zeolite in the first stage and a conventional non-zeolite hydrotreating catalyst in the second stage.

In the context of the petroleum field, polyaromatics refer to condensed aromatic ring systems, e.g., naphthalene, whereas monoaromatics include not only mononuclear compounds such as benzene derivatives but also non-condensed polynuclear compounds such as diphenyl alkane and alkyl diphenyl.

By a hydrocarbon fraction high in polyaromatic (high fraction) is meant a fraction having at least 20, preferably at least 30% by weight of polyaromatic compounds. By a hydrocarbon fraction low in polyaromatic compounds (low fraction) is meant a fraction having not more than 30%, preferably less than 15% by weight polyaromatic compounds. In general the high fraction contains more than 5%, especially more than 15% by weight of polyaromatic compounds than the low fraction, based on the total weight of each fraction.

The boiling point of the high fraction is generally at least 250°, preferably at least 340° C.

The boiling point of the low fraction is generally at least 50°, especially at least 180° C. and generally at least higher than 120°, especially no more than 340° C.

The initial boiling point of the hydrogenated liquid high fraction from the first stage is generally at least 50°, preferably at least 180° C. In any case the initial boiling point of the feedstock to the first stage will generally be at least 120° especially at least 160° C. higher than the boiling point of the low fraction. (By "boiling point" is meant the initial boiling point determined by ASTM method).

With respect to viscosity, the high fraction, before hydrogenation, will generally have a value of about 20 to 40, especially 25 to 35 centistokes (50° C.), and after hydrogenation in the first stage, a value of about 5 to 15 especially 10 to 12 centistokes (50° C.). The low fraction, on the other hand, will have a substantially lower viscosity than the first stage hydrogenated high fraction, the low fraction having a viscosity of generally about 1 to 5 especially 2 to 4 centistokes (50° C.). The differential viscosity between the low fraction and the hydrogenated high fraction is generally about at least 5, preferably at least 10 centistokes (50° C.).

The relative proportion of the high to the low fractions used in this invention, on a weight basis, is generally about 10:1 to 0.1:1, preferably 3:1 to 1:1, respectively.

The method according to the invention produces high olefin yields equalling those attained with naphtha. As a result of the joint processing of a previously partially hydrogenated hydrocarbon high fraction with a low fraction, substantially better qualities of product are attained in the hydrogenated fractions. The quality attained for the product component having a boiling point higher than 340° C., in particular, is equivalent to products in conventional methods but for which substantially higher hydrogenation pressures are necessary. As a result of the processing of a hydrocarbon fraction high in polyaromatic compounds in conjunction with one low in such compounds, not only is the sulfur content of the final hydrogenated product fractions extremely low, but in contrast to conventional processes, a high-pressure reactor for desulfurating the low fraction can be omitted.

The invention is based on the fact that the refining of at least partially cracked molecules is conducted more efficiently than that of uncracked molecules (i.e., polyaromatic substances). It is assumed that the reason for this is that in the hydrogenation of the high fraction, only the polyaromatic compounds are hydrogenated and cracked (selective degradation), but not the monoaromatic compounds. As a result, in the second hydrogenation stage, the refining stage, what takes place is the hydrogenation of the double bonds and simultaneously a more-complete desulfuration of the starting material, under conditions which are substantially less severe than in conventional methods. Furthermore, as a result of the dilution of the hydrogenated product fraction from the first stage with a fraction low in polyaromatic substances, the thermodynamic balance is also advantageously affected.

It is has been proven to be particularly favorable to perform the degradation of the polyaromatic content in the first stage at pressures of from 50 to 150 bar, preferably 70 to 120 bar, and at temperatures from 350° to 420° C., preferably from 380° to 400° C., and to perform the refining in the second stage at pressures of from 50 to 150 bar, preferably 40 to 120 bar, and at temperatures of from 300° to 420° C., preferably from 330° to 350° C. The product quality attained under these mild conditions corresponds to products in conventional methods, for which a hydrogenation pressure about 50 bar higher, for example, is required. The space velocity is advantageously from 0.5 to 4 $h^{-1}$ and preferably from 1 to 2 $h^{-1}$ in the first stage and from 1 to 6 $h^{-1}$ and preferably from 2 to 4 $h^{-1}$ in the second stage.

In the first stage, the catalyst employed is a conventional zeolitic hydrotreating catalyst, including for example such catalysts described in assignee's U.S. Pat. No. 4,188,281, issued to Wernicke et al, incorporated by reference herein the catalyst being a zeolite of the faujasite structure combined with elements from Groups VIB, VIIB and VIII of the periodic table of the elements, wherein the alkali component of the zeolite is exchange at least partially for ammonium, hydronium, alkaline earth and/or rate earth ions, and the elements are present in a metallic, ionic, oxidic and/or sulfidic form.

In the second stage, a, conventional non-zeolitic hydrotreating catalyst is employed, including for example, those utilizing alumina as carrier (e.g. Ketjen KF 165, and Ketjen KF 840). These catalysts contain catalytic amounts of molybdenum oxide and either nickel oxide or cobalt oxide.

Preferred specific catalyst for the first and second stages are the one described in U.S. Pat. No. 4,188,281 for the first stage, and Ketjen KF 840 for the second stage, respectively.

The advantage of employing the different catalysts in each stage is a hydrocracking step prior to a hydrotreating stage which results in a low conversion and excellent product properties due to deep hydrogenation.

In general, the first stage is conducted generally to the extent of decomposing at least 5, preferably at least 40% by weight of the polyaromatics in the high fraction. Conversely, the first stage is terminated generally before less than 98, especially less than 90% of the non-aromatic double bonds are hydrogenated. Also, during the first stage, generally not more than 40% especially not more than 15% of the monoaromatic compounds are hydrogenated.

The second stage, the refining stage, functions to perform desulfuration and N-bases degradation to generally remove at least 50, preferably at least 90% of the sulfur and sulfur compounds, and at least 30, preferably at least 80% of the N-bases.

In a particularly advantageous embodiment of the method according to the invention, vacuum gas oil is used as the hydrocarbon fraction high in polyaromatic compounds and atmospheric gas oil is used as the hydrocarbon fraction low in such compounds.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

EXAMPLES

The examples discussed below illustrate how with the method according to this invention substantially improved product quality is attained in comparison with a method in which hydrocarbons fractions, one high in polyaromatic compounds and one low in such compounds, are each subjected to hydrogenation separately from one another (henceforth called herein "separate treatment").

With respect to the catalysts employed, for the first stage of the invention, there was employed the catalyst described in U.S. Pat. No. 4,188,281.

For the second stage of the invention, there was employed the catalyst Ketjen KF 840.

In the "separate treatment", the hydrotreatment catalyst for the high fraction was Ketjen KF 840 and the one described in U.S. Pat. No. 4,188,281 (first and second stage).

For the low fraction in the "separate treatment" the hydrotreatment catalyst employed was Ketjen KF 165.

TABLE 1

| | VGO | AGO |
|---|---|---|
| C | 85.19 | 85.33 |
| H | 12.60 | 13.04 |
| S | 2.50 | 1.251 |
| N bases weight in ppm | 209 | 55 |
| Weight average molecular weight | 379 | 242 |
| Density at 15° C. | 0.9184 | 0.8496 |
| Viscosity (cst) 50° C. | 32.75 | 2.92 |
| Bromine number | 6.28 | 2.94 |
| Paraffins + naphthenes % by weight | 51.7 | 67.7 |
| Monoaromatic compounds % by weight | 17.9 | 16.4 |
| Polyaromatic compounds % by weight | 30.4 | 15.9 |

The hydrogenation conditions in the AGO/VGO hydrogenation were as follows:

TABLE 2

| Hydrogenation | Treatment according to the invention: VGO - Degradation of polyaromatic substances | Treatment according to the invention: AGO/VGO* Refining | Separate Treatment: VGO - Degradation of polyaromatic substances | Separate Treatment: AGO - Refining |
|---|---|---|---|---|
| Pressure (bar) | 100 | 100 | .100 | 100 |
| Temperature (°C.) | 385 | 385 | 385 | 385 |
| Space velocity ($h^{-1}$) | 1 | 2 | 0.85 | 4 |

*Starting material: hydrogenation product of the VGO degradation of polyaromatic substances (66.6% by weight) + AGO (33.3% by weight)

The VGO experiments in Tab. 2 are comparable, which is shown by the following considerations.

Treatment according to the invention

| | l/h Feed | l Catalyst | LHSV $\left(\frac{\text{l Feed}}{\text{l Cat} \cdot \text{h}}\right)$ |
|---|---|---|---|
| 1. stage | 1 | 1 | 1 |
| 2. stage | 1.51 (1 l Prod. of 1. stage + 0.5 l AGO) | 0.755 | 2 |
| overall | 1.51 | 1.755 | 0.86 |

overall LHSV is 0.86 which is comparable to 0.85 LHSV of separate VGO treatment

The chemical hydrogen consumption is summarized in Table 3.

TABLE 3

| Hydrogenation | Treatment according to the invention: VGO - Degradation of polyaromatics | Treatment according to the invention: AGO/VGO Refining | Separate Treatment: VGO - Degradation of polyaromatics | Separate Treatment: AGO - Refining |
|---|---|---|---|---|
| $H_2$ consumption (Nl/kg of starting material | 82.2 | 108.4 | 75.2 | 125.5 |
| Total consumption for AGO (33.3%) plus VGO (66.6%) (Nl/kg of starting material | 190.5 | | 108.4 | |

As the table shows, the consumption of hydrogen in the method according to the invention was substantially greater, which supports the conclusion that a more-extensive hydrogenation has taken place.

In Table 4, the product yields of the first and second stages are summarized for the hydrogenation of AGO+VOG in common as provided by the invention, as are the product distributions with separate AGO and VGO processing.

The yields of product reactions are given in percent by weight terms of the starting material.

TABLE 4

| | Treatment according to the invention: VGO - Poly-aromatic degradation | Treatment according to the invention: AGO/VGO Refining | Separate Treatment: AGO - Refining | Separate Treatment: VGO - Poly-aromatic degradation | Separate Treatment: Total product |
|---|---|---|---|---|---|
| $H_2S$, $NH_3$, loss | 0.32 | 0.23 | | 0.74 | 1.00 |
| C1 | 0.05 | 0.14 | | 0.04 | 0.01 |
| C2 | 0.12 | 0.27 | | 0.14 | 0.08 |
| C3 | 0.51 | 0.56 | 2.8 | 0.59 | 0.33 |
| C4 | 0.49 | 0.26 | | 0.45 | 0.22 |
| n C4 | 0.57 | 0.51 | | 0.51 | 0.41 |
| C5-180° C. | 4.75 | 7.12 | 6.7 | 4.99 | 5.03 |
| 180-220° C. | 2.34 | 4.02 | 3.9 | 2.14 | 2.58 |
| 220-340° C. | 9.72 | 32.88 | 73.3 | 12.96 | 29.27 |
| >340° C. | 81.98 | 55.48 | 13.6 | 78.54 | 61.92 |
| Σ | 100.74 | 100.97 | 100.3 | 101.11 | 100.87 |

Here again, a comparison of the two methods shows that the method according to the invention is more favorable and in particular enables the attainment of improved product yields with respect to middle distillates.

The degradation rates of the heterocomponents or of typical characteristic values (S, N-bases, polyaromatic substances, bromine number) are summarized (in relative percent) in Table 5. Here the starting materials (AGO and VGO) were compared with the corresponding product fractions.

TABLE 5

| | Treatment according to the invention: AGO | Treatment according to the invention: VGO | Separate Treatment: AGO | Separate Treatment: VGO |
|---|---|---|---|---|
| Desulfuration | 98.7 | 99.4 | 96.6 | 94.9 |
| N bases degradation | * | 99.8 | * | 42.6 |
| Polyaromatic degradation | 95.6 | 86.2 | 94.3 | 56.9 |
| Bromine number | * | 88.2 | * | 65.1 |

In summary, it can be stated that the two-stage, partially joint hydrogenation of AGO and VGO according to the invention has very great advantages in terms of the attainable degradation rates when compared with the one-stage, separate process. Thus in the two-stage method, in the VOG section, there are obtained 99.4% desulfuration of sulfur compounds, 99.9% degradation of N-bases, 86.2% degradation of polyaromatic compound degradation and 88.2% decrease in bromine number. These attained figures are outstanding for a hydrogenation process at 100 bar and they far exceed the figures attained in the one-stage, separate hydrogenation treatment. With AGO, the differences attained are smaller, because the refining of this section is accomplished much more easily.

Finally, comparison tests were also performed, in which VGO was subjected to a two-stage hydrogenation, first a refining stage and then a polyaromatic degradation.

These tests were performed at two different pressures, that is, 100 and 160 bar, under otherwise identical conditions. The total consumption of chemical hydrogen at 100 bar was 168 Nl per kilogram of starting material and at 160 bar this consumption was 204 Nl per kilogram of starting material.

As these figures show, a hydrogenation yield is attained with the method according to the invention at 100 bar (190.5) which corresponds substantially to a hydrogenation product (204) attained at a pressure that is more than 50 bar higher.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for producing low-molecular weight olefins from heavy hydrocarbons comprising a hydrotreating pretreatment and a subsequent thermal cracking of at least a portion of the hydrotreated product, the improvement which comprises conducting the hydrotreating in two stages with two different hydrotreating catalysts and with two different starting hydrocarbon fractions, wherein in the first stage a first starting hydrocarbon fraction high in polyaromatic compounds is selectively degraded to form a product reduced in polyaromatic compounds, and in the second stage, said product is refined in admixture with a lower viscosity, non-hydrotreated second starting hydrocarbon fraction low in polyaromatic substances to remove sulfur, sulfur compounds and N-bases therefrom, the hydrotreating catalyst in the first stage being a zeolitic catalyst and the hydrotreating catalyst in the second stage being a non-zeolitic catalyst, wherein said first starting hydrocarbon fraction high in polyaromatics has a viscosity of 20–40 centistokes, and after the hydrogenation in the first stage a viscosity of about 5–15 centistokes, and the fraction low in polyaromatics has a viscosity of about 1–5 centistokes, with the differential viscosity between the fraction low in polyaromatics and the hydrogenated high in polyaromatics fraction being about at least 5 centistokes, all viscosities being measured at 50° C.

2. A process according to claim 1, wherein the degradation of the polyaromatic content in the first stage is performed at pressures of from 50 to 150 bar, and at temperatures of from 350° to 420° C., and the refining in the second stage is performed at pressures of from 50 to 150 bar, and at temperatures of from 300° to 420° C.

3. A process according to claim 2, wherein the pressure in the first stage is 70–120 bar.

4. A process according to claim 2, wherein the pressure in the second stage is 40–120 bar.

5. A process according to claim 3, wherein the pressure in the second stage is 40–120 bar.

6. A process according to claim 3, wherein the temperature of the first stage is 380°–400° C.

7. A process according to claim 4, wherein the temperature in the second stage is 330°–350° C.

8. A process according to claim 5, wherein the temperature in the first stage is 380°–400° C. and the temperature in the second stage is 330°–350° C.

9. A process according to claim 8, wherein the space velocity in the first stage is 0.5 to 4 $h^{-1}$, and in the second stage from 1 to 6 $h^{-1}$.

10. A process according to claim 9, wherein the space velocity in the first stage is 1 to 2 $h^{31\ 1}$.

11. A process according to claim 10, wherein the space velocity in the second stage is 2 to 4 $h^{-1}$.

12. A process according to claim 1, wherein a vacuum gas oil is used as the hydrocarbon fraction high in polyaromatic compounds and an atmospheric gas oil is used as the hydrocarbon fraction low in polyaromatic compounds.

13. A process according to claim 5, wherein a vacuum gas oil is used as the hydrocarbon fraction high in polyaromatic compounds and an atmospheric gas oil is used as the hydrocarbon fraction low in polyaromatic compounds.

14. A process according to claim 1, wherein the relative proportions of the fraction high in polyaromatic compounds to the non-hydrotreated fraction low in polyaromatic compounds, on a weight basis, is 10:1 to 0.01:1.

15. A process according to claim 1, wherein the relative proportions of the high to the low fraction, on a weight basis, is 3:1 to 1:1.

16. A process according to claim 1 wherein the non-zeolitic catalyst consists essentially of alumina as a carrier and catalytic amounts of molybdenum oxide and either nickel oxide or cobalt oxide.

17. A process according to claim 16 wherein the catalyst consists essentially of alumina as the carrier and catalytic amounts of molybdenum oxie and nickel oxide.

18. A process according to claim 1, wherein said zeolitic catalyst is a zeolite of the faujasite structure combined with elements from Groups VIB, VIIB and VIII of the periodic table of the elements, wherein the zeolite is ion exchanged at least partially with at least one of ammonium, hydronium, alkaline earth and rare earth ions, and the elements are present in at least one of metallic, ionic, oxidic and sulfidic forms.

19. A process according to claim 16, wherein said zeolitic catalyst is a zeolite of the faujasite structure combined with elements from Groups VIB, VIIB and VIII of the periodic table of the elements, wherein the zeolite is ion exchanged at least partially with at least one of ammonium, hydronium, alkaline earth and rare earth ions, and the elements are present in at least one of metallic, ionic, oxidic and sulfidic forms.

20. A process according to claim 17, wherein said zeolitic catalyst is a zeolite of the faujasite structure combined with elements from Groups VIB, VIIB and VIII of the periodic table of the elements, wherein the zeolite is ion exchanged at least partially with at least one of ammonium, hydronium, alkaline earth and rare earth ions, and the elements are present in at least one of metallic, ionic, oxidic and sulfidic forms.

21. In a process for hydrotreating heavy hydrocarbons, the improvement which comprises conducting the hydrotreating in two stages with two different hydrotreating catalysts, and with two different starting hydrocacrbon fractions, wherein the first stage a first starting hydrocarbon fraction high in polyaromatic compounds is selectively degraded to form a product reduced in polyaromatic compounds, and in the second stage, said product is refined in admixture with a low viscosity, non-hydrogenated second starting hydrocarbon fraction low in polyaromatic substances to remove sulfur, sulfur compounds and N-bases therefrom, the hydrotreating catalyst in the first stage being a zeolitic catalyst and the hydrotreating catalyst in the second stage being a non-zeolitic catalyst, wherein said first starting hydrocarbon fraction high in polyaromatics has a viscosity of 20–40 centistokes, and after the hydrogenation in the first stage a viscosity of about 5–15 centistokes, and the fraction low in polyaromatics has a viscosity of about 1–5 centistokes, with the differential viscosity between the fraction low in polyaromatics and the hydrogenated high in polyaromatics fraction being about at least 5 centistokes, all viscosities being measured at 50° C.

22. A process according to claim 21 wherein the non-zeolitic catalyst consists essentially of alumina as a carrier and catalytic amounts of molybdenum oxide and either nickel oxide or cobalt oxide.

23. A process according to claim 21 wherein the catalyst consists essentially of alumina as the carrier and catalytic amounts of molybdenum oxide and nickel oxide.

24. A process according to claim 21, wherein said zeolitic catalyst is a zeolite of the faujasite structure combined with elements from Groups VIB, VIIB and VIII of the periodic table of the elements, wherein the zeolite is ion exchanged at least partially with at least one of ammonium, hydronium, alkaline earth and rare earth ions, and the elements are present in at least one of metallic, ionic, oxidic and sulfidic forms.

25. A process according to claim 22, wherein said zeolitic catalyst is a zeolite of the faujasite structure combined with elements from Groups VIB, VIIB and VIII of the periodic table of the elements, wherein the zeolite is ion exchanged at least partially with at least one of ammonium, hydronium, alkaline earth and rare earth ions, and the elements are present in at least one of metallic, ionic, oxidic and sulfidic forms.

26. A process according to claim 23, wherein said zeolitic catalyst is a zeolite of the faujasite structure combined with elements from Groups VIB, VIIB and VIII of the periodic table of the elements, wherein the zeolite is ion exchanged at least partially with least one of ammonium, hydronium, alkaline earth and rare earth ions, and the elements are present in at least one of metallic, ionic, oxidic and sulfidic forms.

27. A process according to claim 1 wherein the first starting hydrocarbon fraction high in polyaromatics compounds has a viscosity of 25–35 centistokes, and after hydrogenation in the first stage, a visocity of about 10–12 centistokes, in the starting fraction low in polyaromatic compounds has a viscosity of 2–4 centistokes, with the differential viscosity between the fraction low in polyaromatics and the hydrogenated first fraction high in polyaromatics being at least 10 centistokes, all viscosities being measured at 50° C.

28. A process according to claim 21, wherein said first starting hydrocarbon fraction high in polyaromatics has a viscosity of 25–35 centistokes, and after the hydrogenation in the first stage a viscosity of about 10–12 centistokes, and the fraction low in polyaromatics has a viscosity of about 2–4 centistokes, with the differential viscosity between the fraction low in polyaromatics and the hydrogenated high in polyaromatics fraction being about at least 10 centistokes, all viscosities being measured at 50° C.

* * * * *